United States Patent [19]

Heyn et al.

[11] Patent Number: 5,062,628

[45] Date of Patent: Nov. 5, 1991

[54] EXERCISING DEVICE

[76] Inventors: Bennington R. Heyn, 1009 Alexander Ave., Ridgefield, N.J. 07657; Joseph J. Gartner, 334 W. Shore Dr., Wyckoff, N.J. 07481

[21] Appl. No.: 491,099

[22] Filed: Mar. 9, 1990

[51] Int. Cl.[5] ..... A63B 5/20

[52] U.S. Cl. ..... 272/75; 272/74; 434/247; D21/191

[58] Field of Search ..... 272/70, 74, 75; 434/247, 250, 255, 392; D21/191, 224, 228

[56] References Cited

U.S. PATENT DOCUMENTS

| | | | |
|---|---|---|---|
| 104,674 | 6/1870 | Whitehead | 272/74 |
| 3,061,307 | 10/1962 | Burr | 272/75 |
| 3,072,402 | 1/1963 | McCombs | 272/74 |
| 3,778,053 | 12/1973 | Smith, III et al. | 272/75 |
| 3,958,802 | 5/1976 | Thornton | 272/74 |
| 4,022,462 | 5/1977 | Pena-Kipper | 272/74 |
| 4,135,713 | 1/1979 | Martin | 272/74 |
| 4,315,623 | 2/1982 | Granderson | 272/74 |

*Primary Examiner*—Richard J. Apley
*Assistant Examiner*—Joe H. Cheng
*Attorney, Agent, or Firm*—W. Patrick Quast

[57] ABSTRACT

An exercising device for use by a child or an adult. This device includes a hollow plastic crossbar, and one or more hoops preferably hollow. Each hoop has an outer curved portion and two elongate straight portions with respective end portions. Each end portion has a fixed connection to the crossbar. The fixed connection is a pair of holes in the hollow crossbar, which receive a part of the straight portion with a press fit. The straight portion is adjustable relative to the crossbar by applying more than a preselected force thereon. The hoops are spaced apart at an equal angle spacing in a peripheral direction.

8 Claims, 5 Drawing Sheets

EXERCISING DEVICE

The invention generally relates to an exercising device, and in particular, the invention relates to an exercising device having rigid hoops mounted on a hand-held crossbar.

BACKGROUND OF THE INVENTION

The prior art exercising device includes a hand-held crossbar and a single rope having opposite end portions fixedly connected to respective end portions of the crossbar.

One problem with the prior art exercising device is that it easily becomes entangled in the user's feet, since it is extremely difficult to maintain the rope's momentum such that it keeps its form throughout a revolution.

Another drawback of the prior art exercising device is that there are no means for improving the user's motor and coordination skills in a progressive manner.

SUMMARY OF THE INVENTION

According to the present invention, an exercising device is provided. This exercising device comprises a crossbar with an axis and at least one rigid hoop, the hoop having an arcuate outer portion and having axially spaced end portions fixedly connected to the crossbar.

By using the rigid hoop, the problem of the tripping of the user is avoided. The present invention permits expansion of up to four (4) hoops. This provides a progression for the user which sharpens their eye and hand coordination skills.

The foregoing and other objects, features and advantages will be apparent from the following description of the preferred embodiment of the invention as illustrated in the accompanying drawings.

DESCRIPTION OF THE PREFERRED EMBODIMENT

Figure 1:
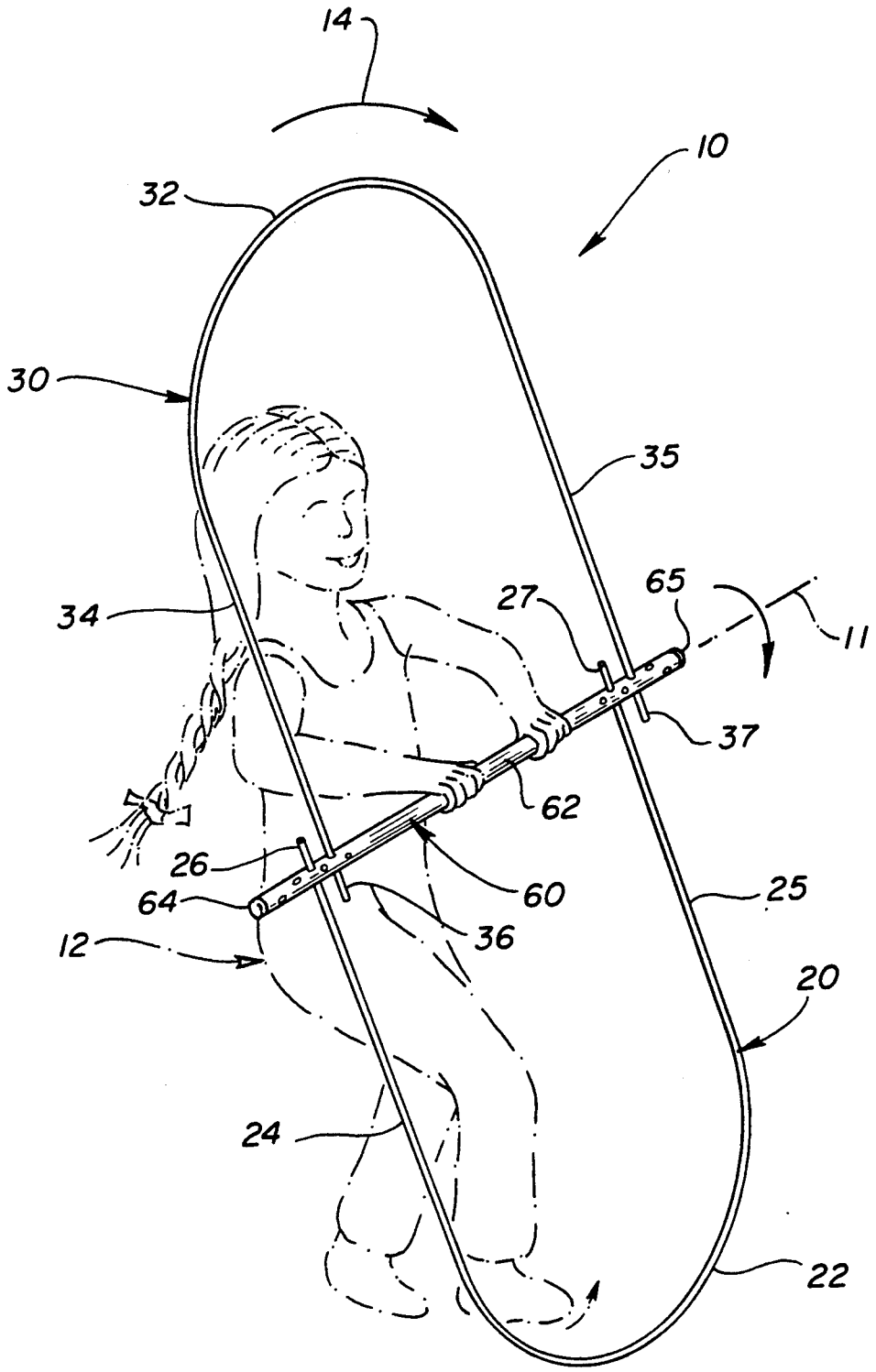
FIG. 1 is a perspective view of an exercising device according to the present invention.

As shown in FIG. 1 through 4, a first embodiment of exercising device 10 is provided for use by an adult or a child 12. Device 10 has an axis of rotation 11 and a direction of rotation 14. Device 10 includes a first hoop 20, a second hoop 30, and a crossbar 60. Hoops 20, 30 and crossbar 60 are hollow, tubular members. The material of hoops 20, 30 is a PVC plastic material. The crossbar 60 typically is made from a PVC material.

First hoop 20 has a radially outer arcuate or curved portion 22, and has elongate straight portions 24, 25, which have respective end portions 26, 27. End portions 26, 27 are fixedly connected to crossbar 60, and are axially spaced apart. Second hoop 30 also has a radially outer curved portion 32, and has elongate straight portions 34, 35, which have respective end portions 36, 37. Crossbar 60 has a center portion 62 and has opposite end caps 64, 65. Crossbar 60 has a plurality of pairs of holes 66, 67, 68, 69 at the left end thereof, and has a plurality of pairs of holes 70, 71, 72, 73 at the right end thereof. These pairs of holes at each end are disposed at alternating 90 degree positions. Outboard of pairs 66, 67, 68, 69 are two additional pairs of holes, 76, 77. Outboard of pairs 70, 71, 72, 73 are two additional pairs of holes, 78, 79 (see FIG. 2). End portions 26, 27, 36, 37, are a press fit into bushings (see FIG. 6) in respective holes 66, 71, 68, 73. Hoops 20, 30 can be forced radially inwardly by the application of respective forces 74, 75 thereon. In this way, hoops 20, 30 are adjustable in a radial direction to accommodate different user heights.

Figure 2:
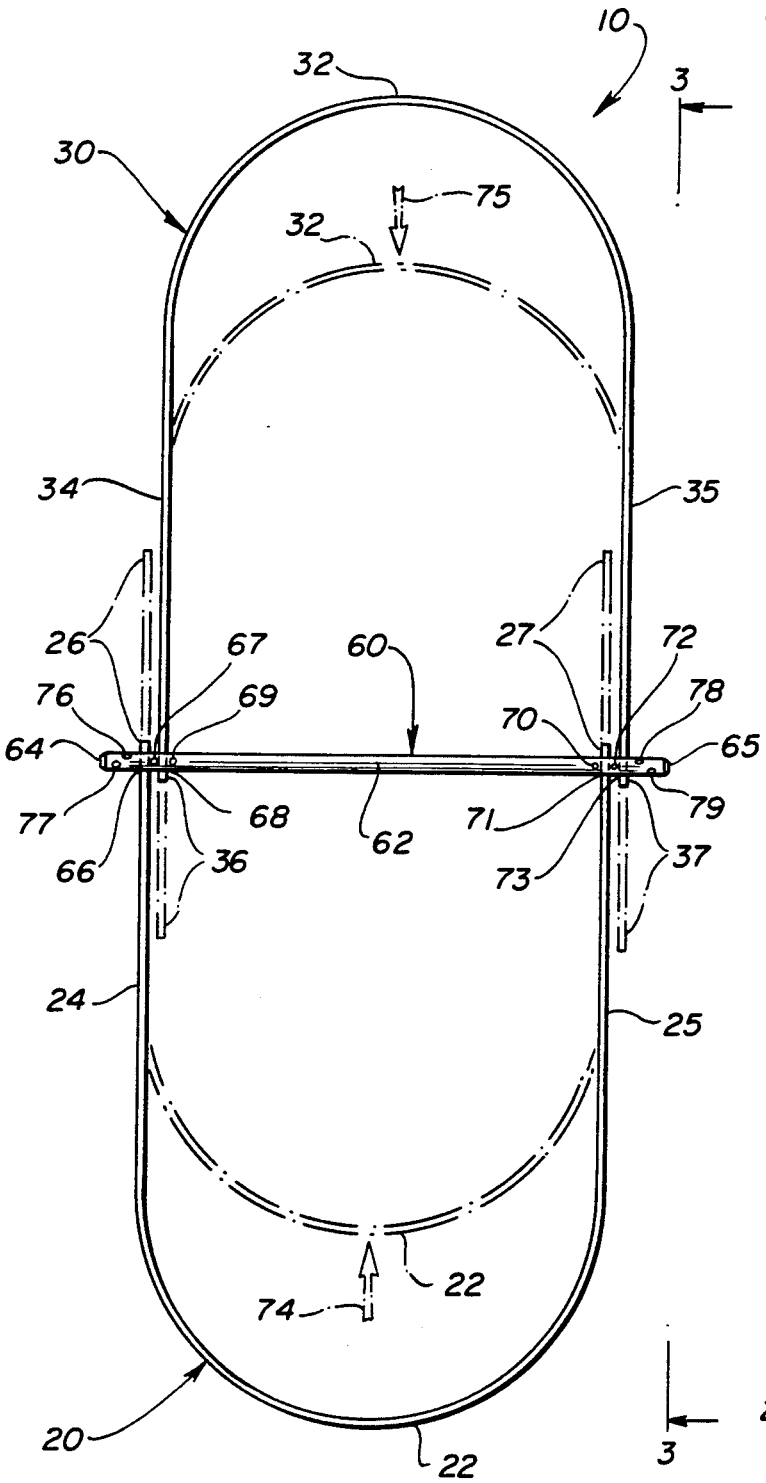
FIG. 2 is an elevation view of the exercising device of FIG. 1.
Figure 3:
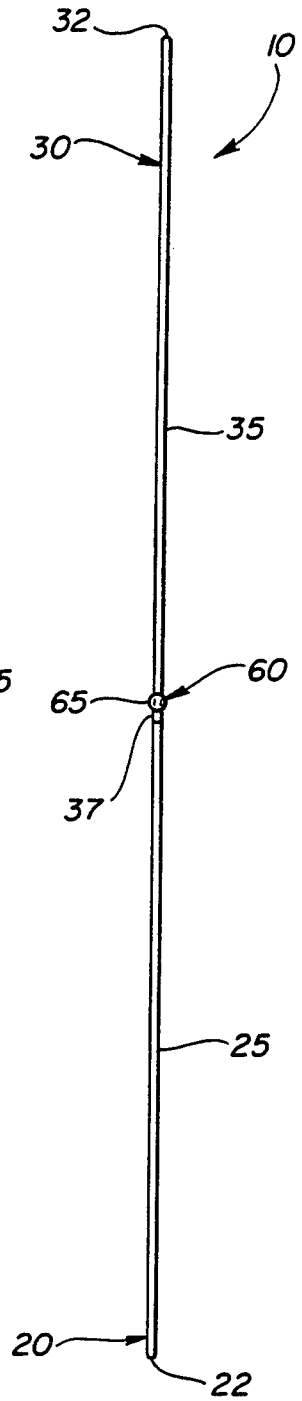
FIG. 3 is an elevation view as taken along the line 3—3 of FIG. 2.
Figure 4:
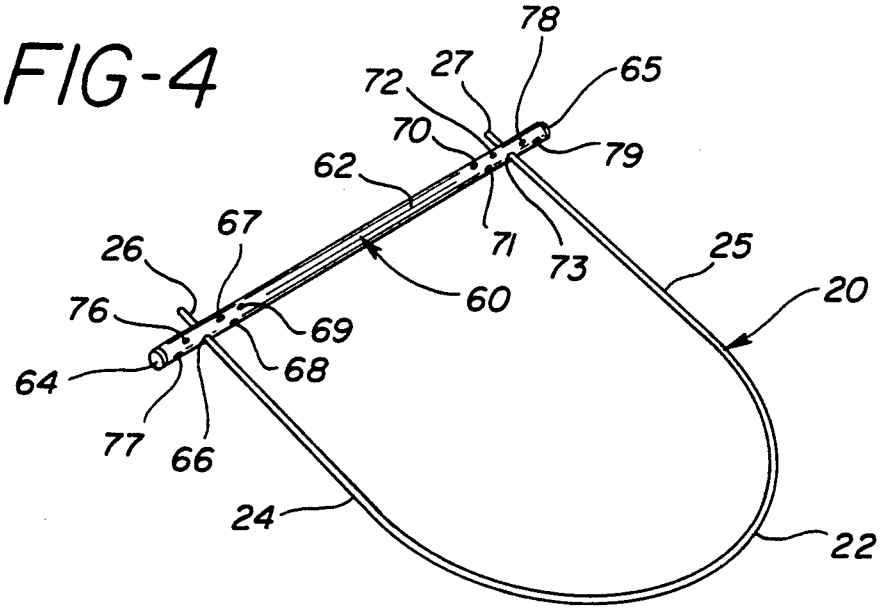
FIG. 4 is a perspective view of a simpler version of the exercising device of FIG. 1.

FIGS. 1, 2, and 3 show the device 10 assembled with two hoops 20, 30, FIG. 4 shows the device 10, but with hoop 30 removed or disassembled therefrom. In using the device 10, a child 12 may prefer to start with only one hoop 20; and later, after successful use of the device 10 with one hoop 20, use the device 10 with both hoops 20, 30.

In one prototype of device 10, crossbar 60 has about a one inch outside diameter and a three-quarter inch inside diameter. Also, tubes 20 and 30 have a three-eighths inch outside diameter and a one-quarter inch inside diameter. Each hole pair 66, 67, 68, 69, 70, 71, 72, 73, 76, 77, 78, 79, has about a three-eighths inch inside diameter and a press fit clearance.

Figure 5:
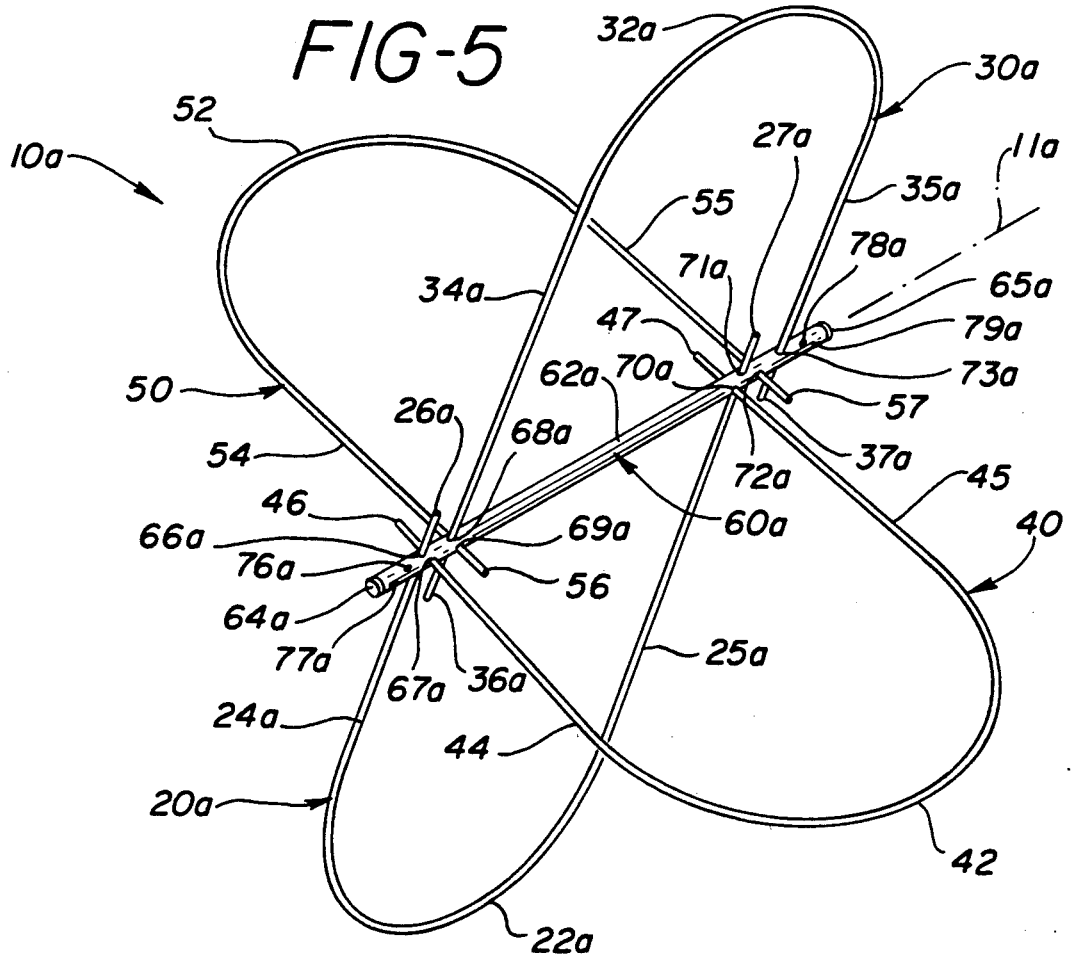
FIG. 5 is a perspective view of a second embodiment of an exercising device according to the present invention.

As shown in FIG. 5, a second embodiment of device 10 is provided. Parts of the second embodiment 10*a*, which are the same as parts of the first embodiment 10, have the same numerals, but with a subscript "a" added thereto. Device 10*a* has an axis 11*a*. Device 10*a* includes a first hoop 20*a*, a second hoop 30*a*, a crossbar 60*a*, a third hoop 40 and a fourth hoop 50.

First hoop 20*a* has a curved portion 22*a*, two straight portions 24*a*, 25*a*, and end portions 26*a* 27*a*. Second hoop 30*a* has a curved portion 32*a*, two straight portions 34*a*, 35*a*, and end portions 36*a*, 37*a*. Crossbar 60*a* has a center portion 62*a*, and has opposite end caps 64*a*, 65*a*. Crossbar 60*a* also has a plurality of pairs of holes, 66*a*, 67*a*, 68*a*, 69*a*, 76*a*, 77*a*, at the left end thereof. Crossbar 60*a* also has a plurality of pairs of holes 70*a*, 71*a*, 72*a*, 73*a*, 78*a*, 79*a*, at the right end thereof. Hoops 20*a*, 30*a*, 40, 50 have a 90-degree angular spacing about axis 11*a*.

Third hoop 40 has a curved portion 42, and elongate straight portions 44, 45 with respective end portions 46, 47. Fourth hoop 50 has a curved portion 52 and elongate straight portions 54, 55 with respective end portions 56, 57.

Figure 6:
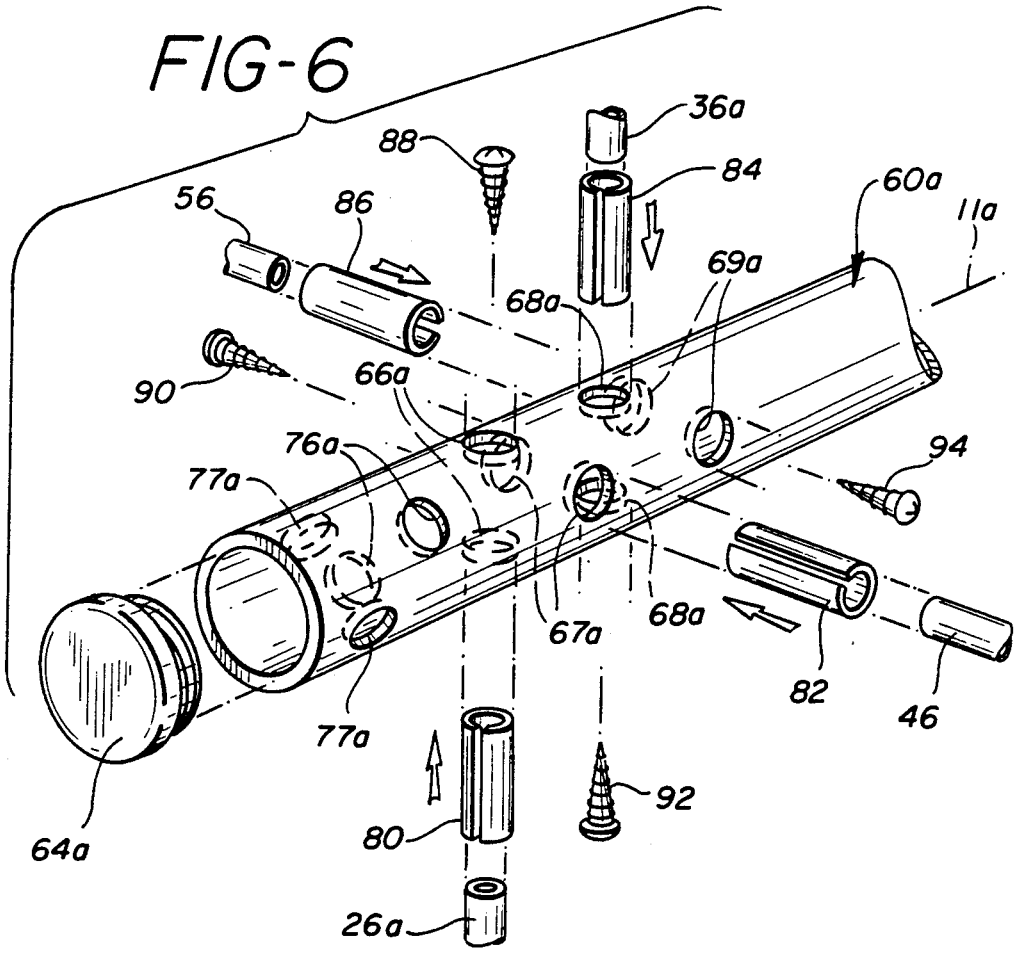
FIG. 6 is an exploded perspective view of a portion of the exercising device of FIG. 5.
Figure 7:
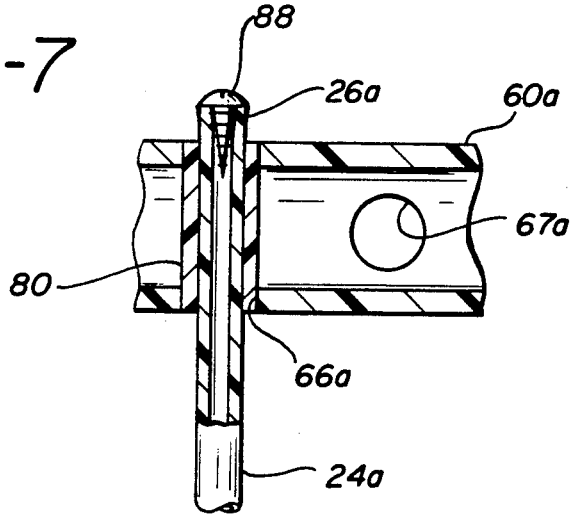
FIG. 7 is a section view of a portion of the exercising device according to the present invention.

As shown in FIGS. 6 and 7, typical pairs of holes 66*a*, 67*a*, 68*a*, 69*a*, have respective split rings or bushings 80, 82, 84, 86. End portions 26*a*, 46, 36*a*, 56 have respective plugs or screws 88, 90, 92, 94. As shown in FIG. 7, typical end portion 26*a* is assembled in bushing 80 which is assembled in pair of holes 66*a*. Screw 88 is thereafter tightened thereby expanding end portion 26*a* and bushing 80. In this way, end portion 26*a* is locked to crossbar 60*a*. In one prototype, the bushing 80 or 82 or 84 or 86 had a one-half inch outside diameter.

In device 10*a*, hoops 20*a*, 30*a*, 40, 50 and cross bar 60*a* are made of a PVC plastic material. Bushings 80, 82, 84, 86 are made of a nylon material.

Figure 8:
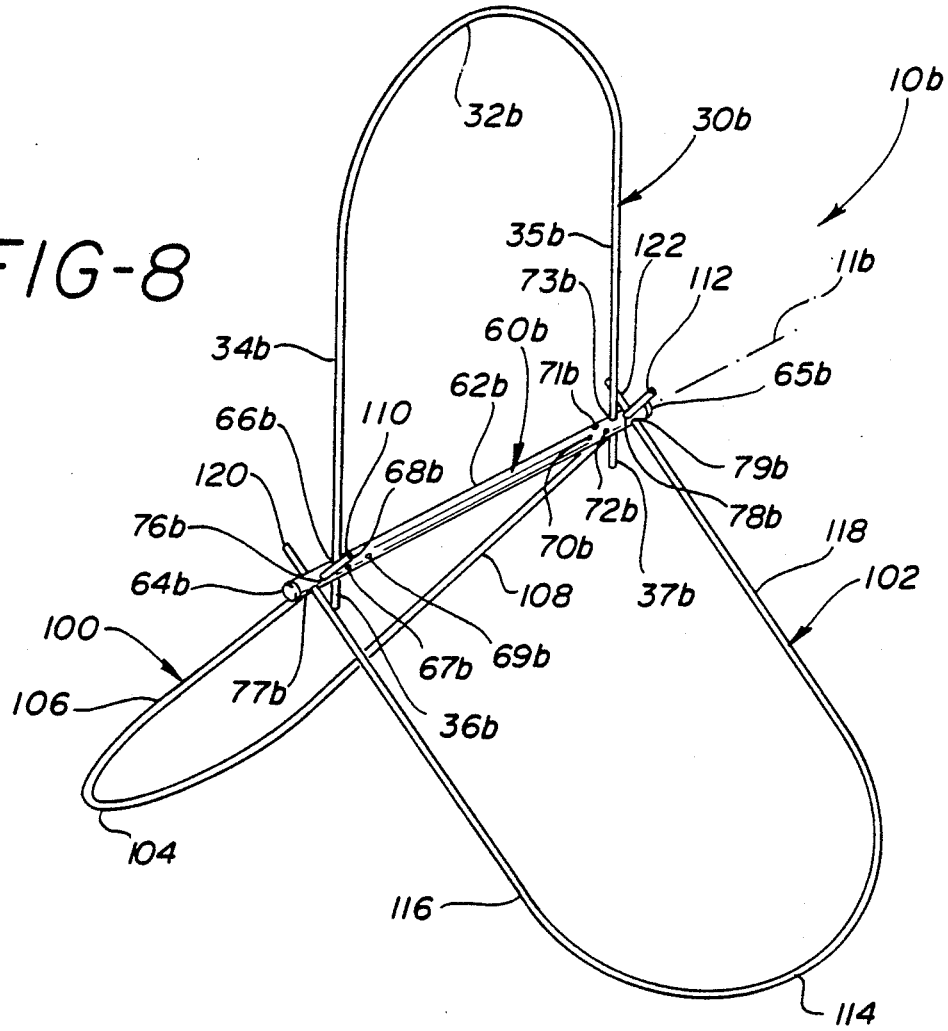
FIG. 8 is a perspective view of a third embodiment of an exercising device according to the present invention.

In FIG. 8, a third embodiment of device 10 is shown. In the following discussion parts of third embodiment 10 which are the same as the first embodiment 10, will have the same numerals but with the subscript "b" added.

Device 10*b* has an axis 11*b*. Device 10*b* includes a first hoop 30*b*, a second hoop 100, a crossbar 60*b*, and a third hoop 102.

First hoop 30*b* has a curved portion 32*b*, two straight portions 34*b*, 35*b* and end portions 36*b*, 37*b*. Second hoop 100 has a curved portion 104, two straight portions 106, 108, and end portions 110, 112. Third hoop 102 has a curved portion 114, two straight portions 116, 118 and end portions 120, 122.

Figure 8A:
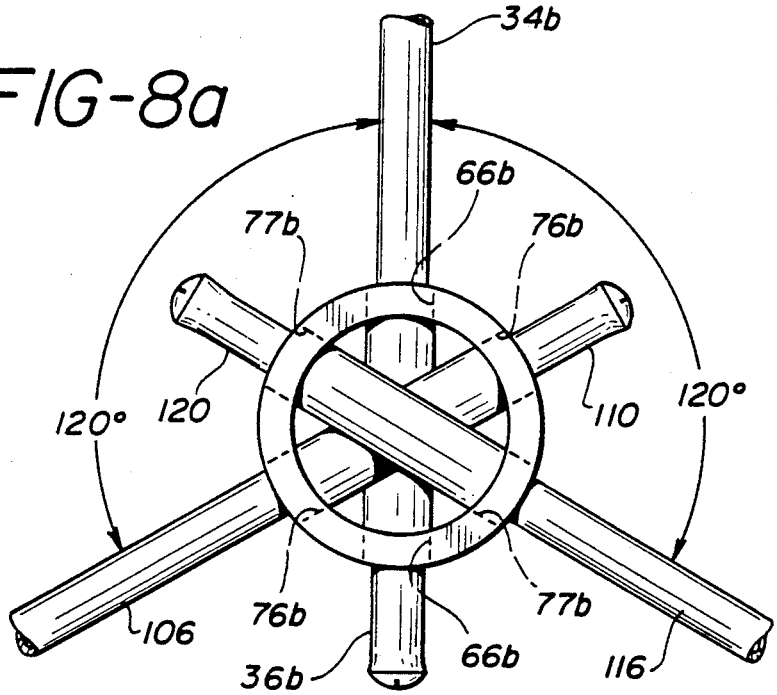
FIG. 8*a* is an end view of a portion of the third embodiment of the invention, with the end cap removed.

Crossbar 60*b* has a center portion 62*b* and has opposite end caps 64*b*, 65*b*. Crossbar 60*b* also has a plurality of pairs of holes, 66*b*, 67*b*, 68*b*, 69*b*, 76*b*, 77*b* at the left end thereof. Crossbar 60*b* also has a plurality of pairs of holes 70*b*, 71*b*, 72*b*, 73*b*, 78*b*, 79*b* at the right end thereof. Referring to FIG. 8*a*, the end portions 36*b*, 37*b* of first hoop 30*b* are inserted in hole pairs 66*b*, 73*b* respectively. End portions 110, 112 of second hoop 100 are inserted in hole pairs 76*b*, 78*b* respectively. End portions 120, 122 of third hoop 102 are inserted in hole pairs 77*b*, 79*b*. End portions 110, 112 are inserted into hole pairs 76*b*, 78*b* from the direction which permits straight portions 106, 108 to be angularly disposed 120 degrees from straight portions 34*b*, 35*b*. End portions 120, 122 are inserted into hole pairs 77*b*, 79*b* from the direction which permits straight portions 116, 118 to be angularly disposed 120 degrees from straight portions 106, 108. Each of the end portions are disposed in bushings such as described above in the embodiment of FIGS. 6 and 7; and have respective screws inserted in end portions 36*b* 37*b*, 110, 112, 120, 122 to expand the end portion in its respective bushing.

Again, in device 10*b*, hoops 30*b*, 100, 102 and crossbar 60*b* are made of PVC plastic material. The bushings are made of a nylon material The advantage of devices 10, 10*a*, and 10*b*, is that a child 12, or user is not as easily tripped by the rigid hoop as by the prior art rope. Another advantage is that a child 12 can improve eye and muscle coordination, as he or she progresses from one to two, to three, to four hoops.

In operation, the user holds the crossbar 60 or 60*a* in both hands close to the body, waist-high, with the top hoop clearing the head. The user turns the crossbar slowly, standing in one location, or running forward and jumping over the hoops, as it passes under the feet.

While the invention has been described in its preferred embodiments, it is to be understood that the words which have been used are words of description rather than limitation and that changes may be made within the purview of the appended claims without departing from the true scope and spirit of the invention in its broader aspects.

For example, the hoops in the various embodiments can be made from solid plastic material instead of hollow tubes. Also, the bushings can be made of another material instead of the nylon.

The embodiments of the invention in which an exclusive property or right is claimed are defined as follows:

1. An exercising device comprising:

a crossbar, extending axially in only one direction, for holding and turning about an axis of rotation by a user;

at least a first, one-piece, bendable member for forming a first hoop, said member including two end portions;

said end portions each having a fixed connection to the crossbar, each said fixed connection including a thru-hole in the crossbar and a portion of the corresponding end portion received in means for restraining axial movement of said end portion in said thru-hole, each said end portion and said thru-hold cooperatively adapted whereby each said end portion can be adjustably positioned in the corresponding thru-hole by the application of a preselected force such that the size of the hoop can be variably adjusted to accommodate the size of each particular user, and whereby each said end portion and said corresponding means for restraining axial movement in said corresponding thru-hole includes a press fit relationship therebetween whereby, after the hoop size is set, the end portion is thereafter substantially restrained in axial movement in the corresponding thru-hole until said preselected force is once again applied.

2. The device of claim 1, wherein each said means for restraining axial movement includes a split bushing disposed in a corresponding thru-hole and having a selective screw for expanding an outside diameter of the end portion for expanding an outside diameter of the bushing for bearing against an inside diameter of the corresponding thru-hole.

3. The device of claim 2, wherein said crossbar and said hoop are hollow members made of a plastic material.

4. The device of claim 3, wherein said cross bar has an end cap at each end thereof.

5. The device of claim 1, including a second, one-piece, bendable member for forming a second hoop spaced in a peripheral direction at about a 180 degree angle from the first hoop.

6. The device of claim 5, including a third and fourth, one-piece, bendable members for forming a third hoop and a fourth hoop, said third and fourth hoop each spaced in a peripheral direction, on opposite sides, at about 90 degrees from the first hoop.

7. The device of claim 1, including a second and third, one-piece, bendable members for forming a second hoop and a third hoop spaced in a peripheral direction, on opposite sides, at about 120 degrees from the first hoop.

8. The device of claim 1, wherein said crossbar includes a first set of peripherally spaced thru-holes, comprising four separate thru-holes each spaced in a peripheral direction at about 90 degrees one from the other; and a second set of peripherally spaced thru-holes, comprising three separate thru-holes each spaced in a peripheral direction at about 120 degrees one from the other, to accommodate different combinations of additionally, one-piece, bendable members, each of said bendable members having end portions, each said end portion having said fixed connection to respective ones of said peripherally spaced holes whereby additional hoops are formed as desired.

* * * * *